US005935902A

United States Patent [19]

Imamura

[11] Patent Number: 5,935,902

[45] Date of Patent: Aug. 10, 1999

[54] IMAGE TRANSFER SHEET AND IMAGE FORMING METHOD

[75] Inventor: Naoya Imamura, Shizuoka, Japan

[73] Assignee: Fuji Photo Film Co., Ltd., Kanagawa, Japan

[21] Appl. No.: 08/672,586

[22] Filed: Jun. 28, 1996

[30] Foreign Application Priority Data

Jun. 30, 1995 [JP] Japan ..... 7-187869

[51] Int. Cl.[6] ..... B41M 5/035; B41M 5/38

[52] U.S. Cl. ..... 503/227; 428/195; 428/474.4; 428/913; 428/914; 430/200; 430/201; 430/945

[58] Field of Search ..... 428/195, 913, 428/914, 474.4; 430/200, 201, 945; 503/227

[56] References Cited

U.S. PATENT DOCUMENTS 5,534,383 7/1996 Takahashi et al. ..... 430/201

*Primary Examiner*—Bruce H. Hess

*Attorney, Agent, or Firm*—Birch, Stewart, Kolasch & Birch, LLP

[57] ABSTRACT

An image transfer sheet consists of a support sheet, a light-heat conversion layer and an image formation layer; or a support sheet, a light-heat conversion layer, a heat-sensitive releasing layer and an image formation layer. The light-heat conversion layer is formed by coating a coating liquid containing a light-heat conversion material and polyamide acid to form a coated layer and drying the coated layer. A composite is composed the image transfer sheet and an image receiving sheet having a substrate and an image receiving layer thereon. An image forming method is conducted using the composite by means of laser light.

21 Claims, 2 Drawing Sheets

IMAGE TRANSFER SHEET AND IMAGE FORMING METHOD

FIELD OF THE INVENTION

This invention relates to a method for forming an image of high resolution using a laser light, and an image transfer sheet and a composite of an image transfer sheet and the image receiving sheet which are favorably employable for the image forming method. Particularly, the invention relates to an image forming method favorably employable for preparing a color proof (DDCP: Direct Digital Color Proof) or a masking image in the field of printing, and an image transfer sheet and composite of the sheet and an image receiving sheet favorably employable for the image forming method.

BACKGROUND OF THE INVENTION

In the field of graphic art, a set of separated color images are prepared from a color original sheet using a lith type film, and a final color image sheet is prepared using the separated color images. Prior to the final printing, a color proof is generally prepared to check for any mistakes possibly introduced in the preparation of the set of separated color images and to further check whether color adjustment is required. A paper sheet is generally employed as the material for preparing the color proof because the color proof should be analogous to the finally printed paper sheet. For the same reason, a pigment is preferably employed as coloring material. Further desired is a high resolution so that a half tone is precisely reproduced. Furthermore desired is an enhanced reliability of the process.

Recently, there arises a demand for a process for preparing a color proof by a dry process, namely, a development process using no developing solution.

At the present time, the stage prior to the printing, namely, prepress, is highly computerized. Therefore, a process and material for directly reproducing a color proof from a set of digital signals is required. In such a computerized system, it is needed to produce a color proof of extremely high quality. Generally, an image of at least 150 lines/inch is required. For preparing a proof of such a high quality from digital signals, a laser light which is highly coherent and which can be modulated by digital signals should be employed as a recording head. Therefore, it is required to develop a recording material which shows high sensitivity to laser light and shows light resolution as to reproduce very fine dots.

Various recording materials employable for a transfer image forming method utilizing a laser beam are known. Japanese Patent Provisional Publication No. 5(1993)-58045 discloses a recording material comprising a support, a light-heat conversion layer thereon which absorbs a laser light and instantly produces a heat and an image forming layer, which is provided on the heat-light conversion layer, comprising pigment dispersed in a binder such as wax. The image forming method using the recording material comprises the steps of: applying a laser light imagewise the light-heat conversion layer from the support side to produce a heat in the light exposed area of the light-heat conversion layer, fusing the image forming layer in an area corresponding to the light exposed area by the heat, and transferring the fused image forming layer onto an image receiving sheet to form an image. Japanese Patent Provisional Publications No. 63(1988)-104882 and No. 4(1992)-208496 disclose a recording material comprising a support, a light-heat conversion layer and an image forming layer comprising sublimation dye dispersed in a binder. The image forming method using the recording material comprises the steps of: applying a laser light imagewise the light-heat conversion layer to produce a heat in the light exposed area, sublimating the dye in an area corresponding to the light exposed area by the heat, and transferring the sublimated dye onto an image receiving sheet to form an image.

Further, Japanese Patent Provisional Publication (for PCT application) No. 2-501552 discloses a recording material which is employable for reproducing an image of very fine halftone by means of the above-mentioned laser light which is highly coherent and can be modulated by digital signals. The recording material comprises a transparent support, an image forming surface layer, which turns fluidal upon receiving a heat, and an image forming material layer of porous or granular material. When the laser light is applied, the image forming material layer in the area exposed to the laser light is fixed onto the support. Then, the unexposed area of the image forming material layer is peeled off to leave an image formed of the exposed image forming materials layer on the support.

In the above image forming method, the image is formed directly on the transparent support. Therefore, the employable support is limited. Further, it is not easy to prepare an image of multi-color. Accordingly, this process is not appropriate for employment as a method for preparing a color proof which generally needs the use of paper sheet (i.e., pulp paper sheet) and on which a multi-color image is generally formed.

Japanese Patent Provisional Publication No. 6(1994)-219052 describes an image transfer sheet which comprises a support, a light-heat conversion layer of a light-heat conversion material, a thermally activable releasing layer of very small thickness (such as 0.03 to 0.3 $\mu$m), and an image forming layer comprising a coloring material. In this image transfer sheet, the bonding force between the image forming layer and the light-heat conversion layer decreases in the area where a laser light is applied. Such a decrease of the bonding force is caused by thermal deterioration of the releasing layer. If an image receiving sheet is beforehand provided on the image forming layer when the laser light is applied to the image transfer sheet, an image of an area exposed to the laser light is transferred onto the image receiving sheet. In this system, the transfer of image is accomplished by so called "ablation". In more detail, the releasing layer decompose to produce a gas in the exposed area to the laser light, and hence the bonding strength between the light-heat conversion layer and the image forming layer decreases in that area. The image forming layer on that area is then transferred onto the image receiving sheet. The image forming system utilizing the "ablation" is favorable in that a paper sheet having an adhesive undercoat can be employed as the image receiving sheet and a multi-colored image with fine tone can be easily prepared by placing the image transfer sheets of different colors on the image receiving sheet by turns. Accordingly, this method is advantageously employable for preparing a color proof (particularly, DDCP: Direct Digital Color Proof) or an extremely fine mask image.

Each layer constituting an image transfer sheet employed in the above-mentioned image forming method is formed by the means of coating method, and therefore a coating liquid for forming each layer is desired to be suitable for coating operation or film-forming operation. For example, the light-heat conversion layer comprises a light-heat conversion material (generally dye capable of absorbing a laser light) and binder, and the binder is required to have high dispersibility for the light-heat conversion material and to have high heat resistance because the layer is heated to high temperature when a laser light is applied. Examples of binders contained in the light-heat conversion layer include acrylic homopolymer or copolymer of acrylic monomers such as (meth)acrylic acid or its alkyl esters; celluloses such as cellulose acetate; vinyl polymers such as polystyrene, vinyl chloride/vinyl acetate copolymer, polyvinylbutyral and polyvinyl alcohol; condensation polymers such as polyester and polyamide; rubber thermoplastic resin such as butadiene/styrene copolymer; polyurethane; polyimide; epoxy resin; and urea/melamine resin. These examples are, for example, described in Japanese Patent Provisional Publications No. 5(1993)-58045 and No. 6(1994)-219052 mentioned previously. Of these polymers, polyimide has high heat resistance. Polyimide is, however, hardly dissolved in an organic solvent and therefore it is difficult to prepare a coating liquid of polyimide. Thus, as polymers for the light-heat conversion layer, polyvinyl alcohol, polyvinyl butyral and polyester are usually employed.

SUMMARY OF THE INVENTION

The present inventor has studied the above polymers used for the light-heat conversion layer and determined as follows: When a light-heat conversion layer is formed using, as a binder, a water-soluble resin such as polyvinyl alcohol, the layer shows poor humidity resistance. For instance, when the layer is allowed to stand for a long period under the conditions of high temperature and humidity, aggregation of dye contained in the layer occasionally occurs. When a light-heat conversion layer is formed using polyvinyl butyral or polyester which almost free from the above disadvantages, the resultant layer will dissolve or swell in a solvent used for a coating liquid for heat-sensitive releasing layer or image formation layer which is provided on the light-heat conversion layer, and the dye contained in the light-heat conversion layer migrates to the heat-sensitive releasing layer or image formation layer provided thereon, which occasionally results in lowering of characteristics (e.g., sensitivity) of the heat-sensitive releasing layer or occurrence of fog on the formed image. Further, these polymers do not show high heat resistance, and therefore the light-heat conversion layer containing the polymer tends to discompose or fuse with the upper layers (e.g., image formation layer) due to heat when a laser light is applied, whereby the light-heat conversion layer is locally transferred together with the image formation layer onto an image receiving sheet not giving a good image or the transferring procedure cannot be performed.

An object of the invention is to provide an image transfer sheet having a light-heat conversion layer which does not dissolve or swell in a coating liquid for forming a layer (e.g., image formation layer) provided thereon and has excellent characteristics such as high heat resistance and high humidity resistance, and further gives a good transferred image almost free from fog.

Another object of the invention is to provide an image forming method using a laser beam which is capable of giving a good transferred image almost free from fog and easily performing the transferring procedure.

A further object of the invention is to provide a composite of an image transfer sheet and an image receiving sheet which is suitable for the above image forming method.

The inventor has further studied to obtain a binder suitable for the light-heat conversion layer. As a result, he has found polyamide acid as the binder. In more detail, the polyamide acid has high heat resistance equal to that of polyimide, and can be employed by dissolving it in the specific solvent such as dimethylacetoamide. Therefore, a solution containing polyamide acid can be easily coated without difficulties given in the case of using polyimide, and the resultant light-heat conversion layer is not dissolved or swelled in a solvent used for a coating liquid for forming a layer provided thereon (i.e., heat-sensitive releasing layer or image formation layer). Further, the light-heat conversion layer does not show lowering of the characteristics given by migration of dye or occurrence of fog mentioned above, and the layer does not bring about trouble in the transferring procedure due to high heat resistance.

There is provided by the present invention an image transfer sheet (Type 1) in which a support sheet, a light-heat conversion layer and an image formation layer comprising coloring material and thermoplastic resin are superposed in order, wherein the light-heat conversion layer is formed by coating a coating liquid (coating solution) containing a light-heat conversion material and polyamide acid to form a coated layer and drying the coated layer.

The preferred embodiments of the above-mentioned image transfer sheet are follows:

1) The image transfer sheet wherein the drying of the coated layer is performed at a temperature of not less than 80° C. (generally 80 to 300° C., preferably 80 to 250° C., and especially 80 to 150° C.)

2) The image transfer sheet wherein the polyamide acid is formed by reaction of aromatic tetracaboxylic dianhydride and diamine.

3) The image transfer sheet wherein the ratio of the light-heat conversion material and the polyamide acid is in the range of 1:20 to 2:1, by weight.

4) The image transfer sheet wherein the light-heat conversion layer has the maximum absorbance at a wavelength within 700 to 2,000 nm of 0.1 to 1.8 (preferably 0.1 to 1.3).

5) The image transfer sheet wherein the light-heat conversion layer has a thickness of 0.03 to 0.8 $\mu$m (preferably 0.03 to 0.3 $\mu$m, especially 0.03 to 0.15 $\mu$m).

6) The image transfer sheet wherein the image formation layer has a thickness of 0.2 to 1.5 $\mu$m and is formed of a heat-sensitive ink material comprising 30 to 70 weight % of colored pigment and 25 to 65 weight % of amorphous organic polymer having a softening point of 40 to 150° C.

There is also provided by the invention an image transfer sheet (Type 2) in which a support sheet, a light-heat conversion layer, a heat-sensitive releasing layer and an image formation layer comprising coloring material and thermoplastic resin are superposed in order, wherein the light-heat conversion layer is formed by coating a coating liquid containing a light-heat conversion and polyamide acid to form a coated layer and drying the coated layer.

The preferred embodiment of the above-mentioned image transfer sheet is follows:

1) The thermal transfer sheet wherein the heat-sensitive releasing layer contains a compound producing a gas by heating.

Further, there is provided by the invention an image transfer sheet (Type 3) in which a support sheet, a light-heat conversion layer and an image formation layer comprising sublimation dye and thermoplastic resin are superposed in order, wherein the light-heat conversion layer is formed by coating a coating liquid containing a light-heat conversion and polyamide acid to form a coated layer and drying the coated layer.

Furthermore, there is provided by the invention an image forming method which comprises the steps of:

superposing;

applying a laser light imagewise and sequentially onto the following composite (i.e., composite of the image receiving layer and the image transfer sheet (Type 1) or (Type 2)); and separating the image receiving sheet from other materials of the composite so as to keep on the image receiving sheet an imagewise transferred image formation layer comprising the coloring material and thermoplastic resin.

The image forming method can be advantageously performed using the following composite:

A composite in which comprises the image receiving sheet comprising a support sheet and an image receiving layer thereon and the image transfer sheet (Type 1) or (Type 2) which are superposed in such a manner that the image formation layer is in contact with the image receiving layer.

The method of the invention can be utilized advantageously in preparation of a color proof of full color type.

In more detail, the preparation of a color proof can be performed by the steps of:

superposing a first image transfer sheet (such as a cyan ink sheet) on an image receiving sheet;

placing imagewise a laser light on the back (support sheet) of the first image transfer sheet to form and transfer a color image (cyan image) onto the image receiving sheet;

separating the image transfer sheet from the image receiving sheet so that the color image (cyan image) is retained on the image receiving sheet;

superposing a second image transfer sheet (such as a magenta ink sheet) on the image receiving sheet having the cyan image thereon;

placing imagewise a thermal head on the back of the second image transfer sheet to form and transfer a color image (magenta image) onto the image receiving sheet;

separating the image transfer sheet from the image receiving sheet so that the color image (magenta image) is retained on the image receiving sheet;

superposing a third image transfer sheet (such as a yellow ink sheet) on the image receiving sheet having the cyan image and magenta image thereon;

placing imagewise a thermal head on the back of the second image transfer sheet to form and transfer a color image (yellow image) onto the image receiving sheet;

separating the image transfer sheet from the image receiving sheet so that the color image (yellow image) is retained on the image receiving sheet, whereby a multicolor image is formed on the image receiving sheet; and transferring thus prepared multicolor image onto a white paper sheet.

The image transfer sheet of the invention has the light-heat conversion layer employing polyamide acid as a binder. The light-heat conversion layer is not dissolved or swelled in a solvent contained in a coating liquid for forming a layer provided thereon (i.e., heat-sensitive releasing layer or image formation layer). Further, the light-heat conversion layer does not show lowering of the characteristics (e.g., sensitivity) given by migration of dye or occurrence of fog, and the layer does not bring about trouble in the transferring procedure due to high heat resistance and high humidity resistance.

Thus, by using the image transfer sheet of the invention, a good image almost free from occurrence of fog can be obtained. Further, the image transfer sheet of the invention can be advantageously utilized for preparing color proof.

DETAILED DESCRIPTION OF THE INVENTION

The image transfer sheet of the invention is generally utilized for thermal transfer recording by area gradation using a laser beam. The image transfer sheet of the invention include a fused ink transfer sheet (image transfer sheet (Type 1)) comprising a support sheet, a light-heat conversion layer and an image formation layer; an ablation utilizing transfer sheet (image transfer sheet (Type 2)) comprising a support sheet, a light-heat conversion layer, a heat-sensitive releasing layer and an image formation layer; or a sublimation dye transfer sheet (image transfer sheet (Type 3)) comprising a support sheet, a light-heat conversion layer and an image formation layer comprising sublimation dye and thermoplastic resin. The image formation layer of the sheet (Type 1) or (Type 2) comprises coloring material and thermoplastic resin. The image formation layer of the invention is characterized in that the light-heat conversion layer is formed by coating a coating liquid containing a light-heat conversion material and polyamide acid to form a coated layer and drying the coated layer. The image receiving sheet, which is employed together with the image transfer sheet in the image forming method, comprises a substrate and an image receiving layer.

Figure 1:
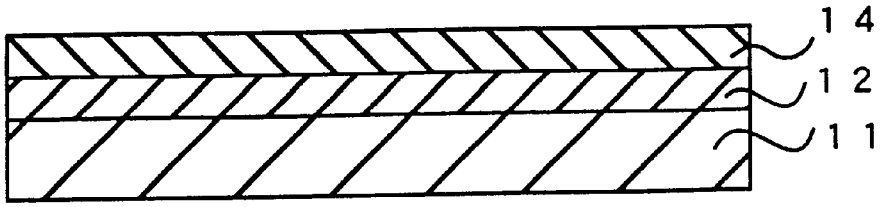
FIG. 1 shows a sectional view of a representative structure of the image transfer sheet of the invention.

The image transfer sheet (Type 1) (fused ink transfer sheet) of the invention is shown in FIG. 1. In FIG. 1, a support sheet 11, a light-heat conversion layer 12 provided thereon and an image formation layer 14 provided on the light-heat conversion layer 12 constitute the image transfer sheet.

Figure 2:
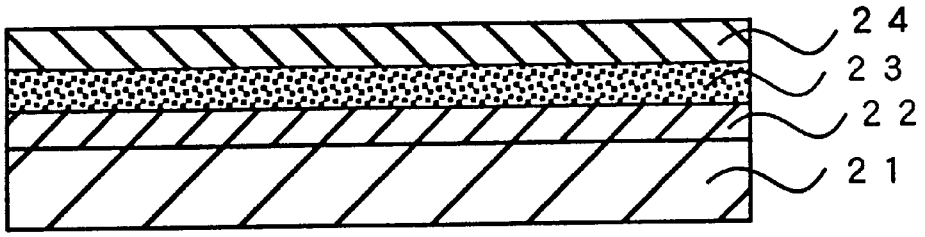
FIG. 2 shows a sectional view of another representative structure of the image receiving sheet of the invention.

The image transfer sheet (Type 2) (ablation utilizing transfer sheet) of the invention is shown in FIG. 2. In FIG. 2, a support sheet 21, a light-heat conversion layer 22 provided thereon, a heat-sensitive releasing layer 23 provided on the light-heat conversion layer 22, and an image formation layer 24 provided on the heat-sensitive releasing layer 23 constitute the image transfer sheet.

Figure 3:
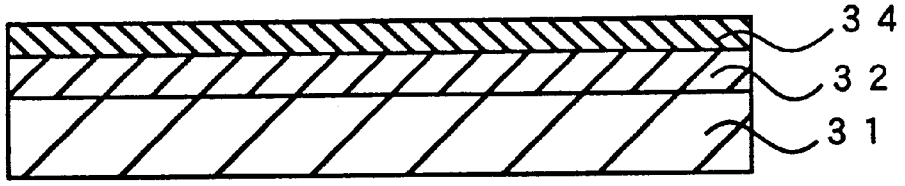
FIG. 3 shows a sectional view of the other representative structure of the image receiving sheet of the invention.

The image transfer sheet (Type 3) (sublimation dye transfer sheet) of the invention is shown in FIG. 3. In FIG. 3, a support sheet 31, a light-heat conversion layer 32 provided thereon and an image formation layer 34 containing sublimation dye provided on the light-heat conversion layer 32 constitute the image transfer sheet.

The same support sheet and the light-heat conversion layer can be employed in the three type image transfer sheets.

As the support sheet, any of the materials of the support sheet employed in the conventional fused ink transfer system and sublimation ink transfer system can be employed. The support sheet is generally made of materials through which light passes. Examples of the materials include polyethylene terephthalate (PET), polyethylene-2,6-naphthalate (PEN), polycarbonate, polyethylene, polyvinyl chloride, polyvinylidene chloride, polystyrene and styrene/acrylonitrile copolymer. Preferred are a polyethylene terephthalate and polypropylene. Especially, biaxially oriented polyethylene terephthalate is preferred from the viewpoint of mechanical strength and dimensional stability. The thickness of the support sheet generally is in the range of 2 to 200 μm, and preferably in the range of 3 to 150 μm.

Further, the support sheet is preferably subjected to a surface activated treatment such as glow discharge or corona discharge treatment, in order to enhance a bonding strength between the support sheet and the light-heat conversion layer. Otherwise one or two undercoat layer is preferably formed on the surface of the support sheet for the same reason as above. The undercoat layer is preferably formed of materials showing the high bonding strength and excellent heat resistance, and preferably has small heat conductivity in order to depress reduction of the sensitivity caused by heat conductivity. Preferred are polystyrene, styrene/butadiene copolymer and gelatin. The thickness of the undercoat layer is generally in the range of 0.01 to 2 μm. Further, on the other side of the support sheet, various function layers such as an anti-reflective layer may be provided. Otherwise, the other side may be subjected to surface activated treatment.

The light-heat conversion layer of the invention is explained below.

The light-heat conversion layer is a layer obtained by coating a coating liquid containing a light-heat conversion material and polyamide acid on the support sheet to form a coated layer and drying the coated layer.

The light-heat conversion material generally is coloring material such as dye and pigment capable of absorbing a laser light. Examples of the coloring material include black pigments such as carbon black, pigments of large cyclic compounds such as phthalocyanine and naphthalocyanine absorbing a light having wavelength from visual region to infrared region, organic dyes such as cyanine dyes (e.g., indolenine compound), anthraquinone dyes, azulene dyes and phthalocyanine dyes, which are employed as laser absorbing materials of high-density laser recording media such as an optical disc, and dyes of organic metal compounds such as dithiol nickel complex. The light-heat conversion layer preferably is as thin as possible to enhance recording sensitivity, and therefore dyes such as phthalocyanine and naphthalocyanine having a large absorption co-efficient are preferably employed.

Otherwise, inorganic materials such as metal materials can be employed as light-heat conversion material. The metal materials are, for example, employed in the form of particle (e.g., blackened silver).

The polyamide acid contained in the coating liquid (solution) for forming the light-heat conversion layer is obtained by addition reaction of tetracarboxylic dianhydride (preferably aromatic tetracarboxylic dianhydride) and diamine.

Examples of the aromatic tetracarboxylic dianhydride are described below.

1,2,4,5-benzene tetracarboxylic dianhydride, 1,2,3,4-benzene tetracarboxylic dianhydride, 1,4-bis(2,3-dicarboxyphenoxy)benzene dianhydride, 1,4-bis(3,4-dicarboxyphenoxy)benzene dianhydride, 1,3-bis(2,3-dicarboxyphenoxy)benzene dianhydride, 1,3-bis(3,4-dicarboxyphenoxy)benzene dianhydride, 1,2,4,5-naphthalene tetracarboxylic dianhydride, 1,2,5,6-naphthalene tetracarboxylic dianhydride, 1,4,5,8-naphthalene tetracarboxylic dianhydride, 2,3,6,7-naphthalene tetracarboxylic dianhydride, 3,3',4,4'-biphenyl tetracarboxylic dianhydride, 2,2', 3,3'-biphenyl tetracarboxylic dianhydride, 4,4'-bis(3,4-dicarboxyphenoxy)diphenyl dianhydride, bis(2,3-dicarboxyphenyl)ether dianhydride, bis(3,4-dicarboxyphenyl)ether dianhydride, 4,4'-bis(2,3-dicarboxyphenoxy)diphenylether dianhydride, 4,4'-bis(3,4-dicarboxyphenoxy)diphenylether dianhydride, bis(3,4-dicarboxyphenyl)sulfide dianhydride, 4,4'-bis(2,3-dicarboxyphenoxy)diphenylsulfide dianhydride, bis(3,4-dicarboxyphenyl)sulfone dianhydride, 4,4'-bis(2,3-dicarboxyphenoxy)diphenylsulfone dianhydride, 4,4'-bis(3,4-dicarboxyphenoxy)diphenylsulfone dianhydride, 3,3',4,4'-benzophenone tetracarboxylic dianhydride, 2,2', 3,3'-benzophenone tetracarboxylic dianhydride, 2,3', 3,4'-benzophenone tetracarboxylic dianhydride, 4,4'-bis(3,4-dicarboxyphenoxy)benzophenone dianhydride, bis(2,3-dicarboxyphenyl)methane dianhydride, bis(3,4-dicarboxyphenyl)methane dianhydride, 1,1-bis(2,3-dicarboxyphenyl)ethane dianhydride, 1,2-bis(3,4-dicarboxyphenyl)ethane dianhydride, 2,2-bis(2,3-dicarboxyphenyl)ethane dianhydride, 2,2-bis(3,4-dicarboxyphenyl)ethane dianhydride, 2,2-bis[4-(2,3-dicarboxyphenoxy)phenyl]propane dianhydride, 4-(2,3-dicarboxyphenoxy-4'-(3,4-dicarboxyphenoxy)diphenyl-2,2-propane dianhydride, 2,2-bis[4-(3,4-dicarboxyphenoxy)-3,5-dimethylphenyl]propane dianhydride, 2,3,4,5-thiophenone tetracarboxylic dianhydride, 2,3,4,5-pyrrolidine tetracarboxylic dianhydride, 2,3,5,6-pyradine tetracarboxylic dianhydride, 1,8,9,10-phenanthrene tetracarboxylic dianhydride, 3,4,9,10-perylene tetracarboxylic dianhydride, 2,2-bis(3,4-dicarboxyphenyl)hexafluoropropane dianhydride, 1,3-bis(3,4-dicarboxyphenyl)hexafluoropropane dianhydride, 1,1-bis(3,4-dicarboxyphenyl)-1-phenyl-2,2,2-trifluoroethane dianhydride, 2,2-bis[4-(3,4-dicarboxyphenoxy)phenyl]hexafluoropropane dianhydride, 1,1-bis[4-(3,4-dicarboxyphenoxy)phenyl]-1-phenyl-2,2,2-trifluoroethane dianhydride, 4,4-bis[2-(3,4-dicarboxyphenyl)hexafluoroisopropyl]diphenylether dianhydride, 2,3,5-tricarboxycyclopentylacetate dianhydride, cyclopentane tetracarboxylic dianhydride, cyclobutane tetracarboxylic dianhydride, 5-(2,5-dioxotetrahydrofuryl)-3-methyl-3-cyclohexene dicarboxylic dianhydride, bicyclo[2,2,2]-octo-7-ene-2,3,5,6-tetracarboxylic dianhydride, 3,5,6-tricarboxynorbornane dianhydride, and tetrahydrofuran tetracarboxylic dianhydride. Preferred are benzene tetracarboxylic dianhydride, benzophenone tetracarboxylic dianhydride, naphthalene tetracarboxylic dianhydride, biphenyl tetracarboxylic dianhydride, bis(dicarboxyphenyl)ether dianhydride, bis(dicarboxyphenyl)methane dianhydride, bis(dicarboxyphenyl)ethane dianhydride, and bis(dicarboxyphenyl)propane dianhydride.

Examples of diamine for forming polyamide acid are described below.

(1)

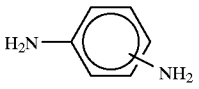

-continued (2)

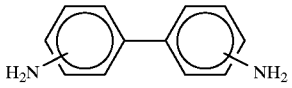

(3)

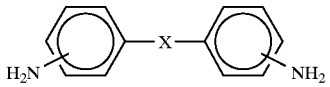

X:

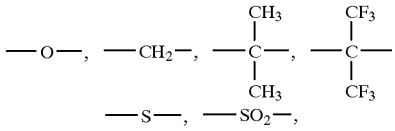

(4)

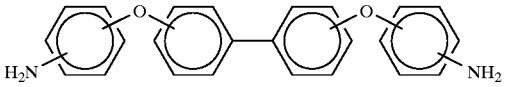

(5)

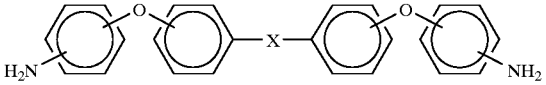

X:

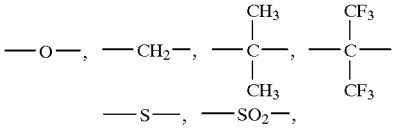

(6)

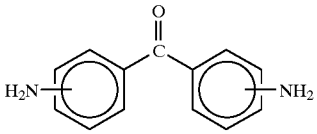

(7)

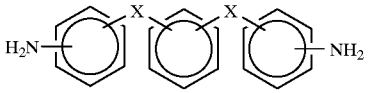

X:

(8)

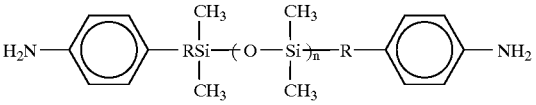

R: alkylene group (preferably having 1–8 carbon atoms)

The light-heat conversion layer can be formed by preparing a coating liquid comprising the light-heat conversion material and a solution of the polyamide acid in solvent, and coating the coating liquid on the support sheet to form coated layer and then drying the coated layer.

Examples of the solvents for dissolving the polyamide acid include amide type solvent such as N,N-dimethylacetoamide (DMAc), N,N-dimethylformamide (DMF) and N-methylpyrrolidone (NMP), phenol solvents such as cresol and chlorophenol, and ethers such as diethylene glycol dimethyl ether.

The coating and drying procedure can be performed according to the known coating and drying methods. The drying is usually conducted at a temperature at not more than 300° C., generally 80 to 300° C., preferably 80 to 250° C., and especially 80 to 150° C. In the case that polyethylene terephthalate is employed as the support sheet, the drying temperature preferably is in the range of 80 to 150° C. A time period for drying preferably is in the range of 0.05 to 10 minutes.

By heating for the drying, some polyamide acids are converted to polyimide in some extend, and therefore the dried light-heat conversion layer is composed of binder comprising polyamide acid having partially imide structure. Other polymers (e.g., polyvinyl butyral and polyvinyl alcohol) other than polyamide acid may be employed. However, polyvinyl alcohol shows poor humidity resistance and therefore it is preferred to not use polyvinyl alcohol. When polyvinyl alcohol is used, it generally is used in an amount of not more than 10 weight % based on the total amount of binder.

A ratio between the amount of the light-heat conversion material and that of the binder preferably is in the range of 1:20 to 2:1 (conversion material:binder) by solid weight, especially in the range of 1:10 to 2:1. When the amount of the binder is less than the lower limit, cohesive force of the light-heat conversion layer lowers and therefore the layer is apt to transfer onto the image receiving sheet together with the image formation layer in the transferring procedure. Further, the light-heat conversion layer containing excess binder needs a large thickness to show a desired light absorption, which occasionally results in reduction of sensitivity.

Accordingly, the thickness of the light-heat conversion layer generally is in the range of 0.03 to 0.8 $\mu$m. preferably in the range of 0.05 to 0.3 $\mu$m, and especially in the range of 0.05 to 0.15 $\mu$m. Moreover, the light-heat conversion layer has the maximum absorbance at wavelengths of 700 to 2,000 nm of 0.1 to 1.8 (preferably 0.1 to 1.3).

In the image forming method utilizing a laser light, the light-heat conversion layer produces much heat to increase the temperature of the layer to extremely high degree. The produced heat is transmitted to the heat-sensitive releasing layer provided thereon. The heat-sensitive releasing layer contains material which emits a gas upon receiving heat from the light-heat conversion layer. Such a material may produced a gas upon thermal decomposition. Otherwise, the material may leave gaseous water which was adsorbed by or attached to the material. The production gas in the heat-sensitive releasing layer causes decrease of the bonding strength between the light-heat conversion layer and the image formation layer in the area where the gas is produced. Therefore, in the case that the heat-sensitive releasing layer is independently provided, the binder of the light-heat conversion layer preferably has a heat resistance higher than that of the releasing layer. In other words, the binder of the light-heat conversion layer is relatively stable when the heat-sensitive releasing layer decomposes to produce a gas or releasing the adsorbed gas. The light-heat conversion layer of the invention is formed of polyamide acid, and therefore the conversion layer can have heat resistance higher than material of the releasing layer.

The heat-sensitive releasing layer may be omitted and the heat-sensitive material can be incorporated into the light-heat conversion layer (in the case of the image transfer sheet (Type 1)). Even in this case, the heat-sensitive material produces a gas when the light-heat conversion layer emits heat, and decrease the bonding strength between the light-heat conversion layer and the image formation layer provided thereon.

Accordingly, the light-heat conversion layer may contain the heat-sensitive material. Examples of the material include a compound (e.g., polymer or low-molecular weight compound) which is itself decomposed or changed by means of heating to produce a gas; and a compound (e.g., polymer or low-molecular weight compound) in which a relatively volatile liquid such as water has been adsorbed or absorbed in marked amount. These compounds can be employed singly or in combination of two kinds.

Examples of the polymers which are itself decomposed or changed by means of heating to produce a gas include self-oxidizing polymers such as nitrocellulose; polymers containing halogen atom such as chlorinated polyolefin, chlorinated rubber, polyvinyl chloride and polyvinylidene chloride; acrylic polymers such as polyisobutyl methacylate in which relatively volatile liquid such as water has been adsorbed; cellulose esters such as ethyl cellulose in which relatively volatile liquid such as water has been adsorbed; and natural polymers such as gelatin in which relatively volatile liquid such as water has been adsorbed.

Examples of the low-molecular weight compounds which are itself decomposed or changed by means of heating to produce a gas include diazo compounds and azide compounds.

These compounds which are itself decomposed or changed preferably produce a gas at a temperature not higher than 280° C., especially produce a gas at a temperature not higher than 230° C. (preferably a temperature not lower than 100° C.).

The image transfer sheet (Type 2) of the invention has the heat-sensitive releasing layer provided on the light-heat conversion layer. The heat-sensitive releasing layer is a layer containing a heat-sensitive material. Examples of the material include a compound (e.g., polymer or low-molecular weight compound) which is itself decomposed or changed by means of heating to produce a gas; and a compound (e.g., polymer or low-molecular weight compound) in which a relatively volatile liquid such as water has been adsorbed or absorbed in marked amount. These compounds can be employed singly or in combination of two kinds. Examples of the polymers which are itself decomposed or changed by means of heating to produce a gas include those described above. Examples of the low-molecular weight compounds which are itself decomposed or changed by means of heating to produce a gas include diazo compounds and azide compounds as described above.

In the case that the low-molecular weight compound is employed as the heat-sensitive material of the heat-sensitive releasing layer, the compound is preferably employed together with the binder. The binder may be the polymer which itself decomposes or is changed to produce a gas or a conventional polymer having no property mentioned above. A ratio between the low-molecular weight compound and the binder preferably is in the range of 0.02:1 to 3:1 by weight, especially 0.05:1 to 2:1.

The heat-sensitive releasing layer is preferably formed on the whole surface of the light-heat conversion layer. The thickness preferably is in the range of 0.03 to 1 $\mu$m, especially 0.05 to 0.5 $\mu$m.

In the image transfer sheet (Type 2) comprising a support sheet, a light-heat conversion layer, a heat-sensitive releasing layer and an image formation layer, the heat-sensitive releasing layer may decompose to produce a gas by heat given by the light-heat conversion layer. This means that a gas or the coagulation of the releasing layer is in part broken. Such phenomenon lowers the bonding force between the light-heat conversion layer and the image formation layer. In certain cases, a portion of decomposed or broken heat-sensitive material of the releasing layer may be transferred to the image receiving sheet together with the imagewise transferred image formation layer. The transferred heat-sensitive material or its decomposition product may add unfavorable color to the image. Therefore, the heat-sensitive material preferably has color as little as possible (this means that the material is transparent to visible light). In more detail, the heat-sensitive releasing layer shows absorption of visible light as low as possible, such as not higher than 50%, more preferably not higher than 10%.

In the image transfer sheet (Type 2) shown in FIG. 2, the image formation layer is provided on the heat-sensitive releasing layer provided on the light-heat conversion layer. In the image transfer sheet (Type 1) or (Type 3) shown in FIG. 1 or 3, respectively, the image formation layer is provided on the light-heat conversion layer.

The image formation layer of the image transfer sheet (Type 1) or (Type 2) is formed of materials comprising coloring material for forming a visible observable image and thermoplastic binder. The image formation layer of the image transfer sheet (Type 3) is formed of sublimation dye and thermoplastic binder.

The coloring material contained in the image formation layer of the image transfer sheet (Type 1) or (Type 2), can be employed by selecting from the known dye and pigment.

Examples of the dyes include azo dyes such as Disperse Red Disperse Yellow 3, Disperse Yellow 23 , and Disperse Yellow 60; anthraquinone dyes such as Disperse Violet 28, Disperse Blue 14, Disperse Blue 26, Disperse Red 4, Disperse Red 60 and Disperse Yellow 13; other dyes such as Disperse Yellow 54, Disperse Yellow 61, Disperse Yellow 82 and Disperse Blue 20.

The pigment is generally classified into an organic pigment and an inorganic pigment. The organic pigment is advantageous in imparting high transparency to the image formation layer, and the inorganic pigment is advantageous in its hiding power. When the image transfer sheet of the invention is employed for producing a color proof, an organic pigment of yellow, magenta, cyan or black corresponding or similar to the pigment actually employed for printing is used. Optionally employed is a metal powder or fluorescent pigment.

Examples of the preferred pigments include azo pigments, phthalocyanine pigments, anthraquinone pigments, dioxazine pigments, quinacridone pigments, isoindolinone pigments, and nitro pigments. Representative pigments are as follows:

1) Yellow pigments Hanza Yellow G, Hanza Yellow 5 G, Hanza Yellow 10 G, Hanza Yellow A, Pigment Yellow L, Permanent Yellow NCG, Permanent Yellow FGL, Permanent Yellow HR
2) Magenta Pigments (Red Pigments) Permanent Red 4R, Permanent Red F2R, Permanent Red FRL, Lake Red C, Lake Red D, Pigment Scarlet 3B, Bordeaux 5B, Alizarine Lake, Rohdamine Lake B
3) Cyane Pigments (Blue Pigments) Phthalocyanine Blue, Victoria Blue Lake, Fast Sky Blue
4) Black Pigments Carbon Black Examples of thermoplastic binders include cellulose derivatives such as methyl cellulose, ethyl cellulose and cellulose triacetate; homopolymers and copolymers of acrylic monomers such as methacrylic acid and its ester (e.g., methacrylic acid, methyl methacrylate, ethyl methacrylate, butyl methacrylate, and hydroxyethyl methacrylate), and acrylic acid or its ester (e.g., acrylic acid, methyl acrylate, ethyl acrylate, butyl acrylate, and $\alpha$-ethylhydroxy acrylate); vinyl polymers such as polyvinyl chloride, polyvinyl acetate, polyvinyl butyral and polyvinyl formal; styrene polymers such as polystyrene and styrene/maleic acid copolymer; rubber polymers such as polybutadiene and polyisoprene; polyolefins such as polyethylene and ethylene/vinyl acetate copolymer; phenol resins; and ionomer resins.

Preferred thermoplastic binders have Tg (glass transition temperature) of 30 to 120° C. and especially preferred are butyral resin and acrylic polymers. The thermoplastic binders have a mean molecular weight (weight average molecular weight) of 5,000 to 100,000.

In the image formation layer, the pigment and the thermoplastic binder are preferably incorporated in a ratio by weight of 0.5:1 to 4:1.

Subsequently, an image formation layer of the image transfer sheet (Type 3) (dye sublimation transfer sheet) is explained below.

The image formation layer of the sheet (Type 3) can be formed in the same manner as that of the sheet (Type 1 or 2) except for using sublimation dye as coloring material. Therefore, the image formation layer of the sheet (Type 3) is basically composed of the above-mentioned thermoplastic binder and sublimation dye. In the image forming method using the sheet (Type 3), the sublimation dyes sublimate by heating to form gases and the gases diffuse into the image receiving layer to form an image.

As the sublimation dye, any dyes of yellow dyes, magenta dyes and cyan dyes can be employed.

Examples of the yellow dyes include methine dyes, quinophthlone dyes and azo dyes (e.g., Kayaset Yellow AG, Kayaset Yellow 963, MS Yellow VP, MS Yellow VPH, MS Yellow HSO-246, Macrolex Yellow 6G, Foran Brilliant Yellow S-6GL and SYS-1). Examples of the magenta dyes include anthraquinone dyes, azomethine dyes and azo dyes (e.g., Kayaset Red TD-FB, MS Magenta VP, MS Magenta HM-1450, MS Magenta HSO-147, MS Magenta HM-1450, MS Red G, Macrolex Redviolet R, Kayaset Red 130, SMS-2, SMS-3 and SMS-4). Examples of the cyan dyes include naphthoquinone dyes, anthraquinone dyes and azomethine dyes (e.g., Kayaset Blue 714, Kayaset Blue FR, Kayaset Blue 136, Kayaset Blue 814, Kayaset Blue 778, MS Cyan VPG, MS Cyan HM-1238, MS Cyan HSO-144, MS Cyan HSO-16, Seless Blue and SCM-1).

In the image formation layer of the sheet (Type 3), the sublimation dye and the thermoplastic binder are preferably incorporated in a ratio by weight of 0.5:1 to 4:1 in the same manner as above.

The image forming layer of each of the image transfer sheets (Types 1 to 3) may further contain plasticizer. Particularly in the case of forming a muli-colored image in which plural images of different colors are superposed in order on the image receiving layer, a plasticizer is preferably incorporated into the image formation layer so as to increase adhesion between the layers respectively having the formed image of different color. Examples of the plasticizers include phthalic esters such as dibutyl phthalate, di-n-octyl phthalate, di(2-ethylhexyl) phthalate, dinonyl phthalate, dilauryl phthalate, butyl lauryl phthalate and butyl benzyl phthalate; esters of dibasic aliphatic carboxylic acids such as di(2-ethylhexyl)adipate and di(2-ethylhexyl)sebacate; phosphoric acid triesters such as tricresyl phosphate and di(2-ethylhexyl)phosphate; polyol polyesters such as polyethylene glycol esters; and epoxy compounds such as epoxidized aliphatic carboxylic acid esters.

Also employable are acrylic esters such as polyethylene glycol dimethacrylate, 1,2,4-butanetriol trimethacrylate, trimethylolethane triacrylate, pentaerythritol triacrylate, pentaerythritol tetraacrylate and dipentaerythritol polyacrylate. Such acrylic esters are advantageously employable in combination with compatible binder polymers.

The plasticizers can be employed alone or in combination. The plasticizer can be employed in a ratio by weight of a total amount of the pigment or sublimation dye and binder to the plasticizer in the range of 100:1 to 100:30, especially in the range of 100:2 to 100:15.

The image formation layer may further contain a surfactant and viscosity increasing agent in addition to the above-mentioned components.

The thickness (dry thickness) of the image formation layer varies depending upon the purpose of the image transfer sheet. Generally, the thickness does not exceed 10 μm, and preferably is in the range of 0.1 to 2 μm, especially in the range of 0.1 to 1.5 μm.

The image formation layer is easily damaged if it is placed and handled with no covering. Therefore, the image transfer sheet is generally covered with an image receiving sheet on the side of the image formation layer. Thus covered image transfer sheet is as such stored, delivered and employed for image formation. However, the image transfer sheet can be treated with no covering or with other covering such as a protective plastic film such as polyethylene terephthalate film or polyethylene film.

The image receiving sheet to be employed in the composite and image forming method of the invention is described below.

The image receiving sheet comprises a substrate in the form of a sheet such as plastic sheet, metal sheet, glass plate, or paper sheet, and generally has an image receiving layer (preferably has an image receiving layer through an intermediate layer) on the substrate. Examples of the plastic sheets include polyethylene terephthalate sheet, polycarbonate sheet, polyethylene sheet, polyvinyl chloride sheet, polyvinylidene chloride sheet, polystyrene sheet, and styrene/acrylonitrile sheet. Examples of the paper sheets include printing paper and coated paper. The substrate sheet of the image receiving sheet generally has a thickness of 10 to 400 μm, preferably 25 to 200 μm. The substrate may be subjected to an appropriate surface activating treatment such as corona discharge or glow discharge so that an image receiving layer or an image formation layer can be placed thereon smoothly.

The image receiving sheet preferably has an image receiving layer, or an image receiving layer and intermediate layer, so that an image of the image formation material can be smoothly transferred onto the image receiving sheet from the image formation layer by ablation.

The image receiving layer comprises an organic polymer binder, preferably a thermoplastic polymer binder. Examples of the polymer binders include homopolymers and copolymers of acrylic monomers such as methacrylic acid and its ester (e.g., methacrylic acid, methyl methacrylate, ethyl methacrylate, butyl methacrylate, and hydroxyethyl methacrylate), and acrylic acid or its ester (e.g., acrylic acid, methyl acrylate, ethyl acrylate, butyl acrylate, and α-ethylhydroxy acrylate); cellulose derivatives such as methyl cellulose, ethyl cellulose and cellulose triacetate; vinyl polymers such as polyvinyl chloride, polyvinyl acetate, polyvinyl pyrrolidone, polyvinyl butyral and polyvinyl alcohol; condensation polymer such as polyester and polyamide; and rubber polymers such as butadiene/styrene copolymer. Preferred polymer binders have Tg (glass transition temperature) of lower than 90° C. so that it can smoothly receive the image from the image formation layer of the image transfer sheet. A plasticizer can be incorporated into the image receiving layer so as to adjust the glass transition temperature of the image receiving layer.

The intermediate layer, which is provided between the substrate and the image receiving layer, can be also formed in the same manner as that in the image receiving layer, and preferably has cushion property.

The image forming method can be performed by once transferring the formed image onto the image receiving sheet and further transferred onto a printing paper. In other words, the image receiving sheet attached to the image transfer sheet can be employed as a temporary image receiving sheet. In this case, the image receiving layer or the intermediate layer of the image receiving sheet is preferably made of a photocurable material. A representative example of the photocurable material comprises a photopolymerizable polyfunctional vinyl or vinylidene monomer which can produce a polymer by addition polymerization; an organic polymer; and photopolymerization initiator (and optionally a thermalpolymerization inhibitor).

Examples of the polyfunctional vinyl or vinylidene monomers include unsaturated carboxylic acid esters (preferably acrylic acid and methacrylic acid) of polyols such as ethylene glycol diacrylate, glycerol triacrylate, ethylene glycol dimetahcrylate, 1,3-propanediol dimethacrylate, polyethylene glycol dimethacrylate, 1,2,4-butanetriol trimethacrylate, trimethylolethane trimethacrylate, pentaerythritol dimethacrylate, pentaerythritol trimethacrylate, pentaerythritol tetramethacrylate, pentaerythritol diacrylate, pentaerythritol triacrylate, pentaerythritol tetraacrylate, dipentaerythritol polyacrylate, 1,3-propanediol diacrylate, 1,5-pentanediol dimethacrylate, and bisacrylate or bismethacrylate of polyethylene glycol having a molecular weight of 200 to 400; and unsaturated carboxylic acid amides such as amides of acrylic acid or methacrylic acid with $\alpha$, $\omega$-diamine whose alkylene chain may be cleaved at a carbon atom, and ethylene bismethacrylamide. Also employable are polyester acrylate or polyester methacrylate, that is, condensation products between polycarboxylic acid esters of polyalcohols and acrylic acid or methacrylic acid.

As the organic polymer binder, the thermoplastic resin binder which is previously described in the image receiving layer, can be employed.

The photopolymerizable monomer and the organic polymer binder can be used in a weight ratio of 0.1 to 1.0 to 2.0 to 1.0.

The photopolymerization initiator preferably has absorption at a near ultraviolet ray region but has no or little absorption in visible ray region. Examples of the photopolymerization initiators include aromatic ketones such as benzophenone, Michler's ketone [4,4'-bis(dimethylamino) benzophenone], 4-methoxy-4'-dimethylaminobenzophenone, and 2-ethylanthraquinone; benzoin ethers such as benzoin methyl ether, benzoin ethyl ether, and benzoin phenethyl ether; benzoins such as benzoin, methylbenzoin, and ethylbenzoin; and dimers such as 2-(o-chlorophenyl)-4,5-diphenylimidazole dimer and 2-(o-chlorophenyl)-4,5-(m-methoxyphenyl)imidazole dimer.

The photopolymerization initiator is generally employed 0.1 to 20 weight % per the photopolymerizable monomer.

In the case that the image forming method of the invention is applied to the preparation of color proof, the image receiving sheet generally has the intermediate layer and the image receiving layer thereon. Further, the image receiving layer is preferably made of photo-curable layer, which is to be transferred together with the image of the image formation material transferred from the image transfer sheet onto the final image receiving sheet (i.e., printing paper sheet). Thus produced image receiving sheet serves to give a finally transferred image which is highly analogous to the actually printed image.

Figure 4:
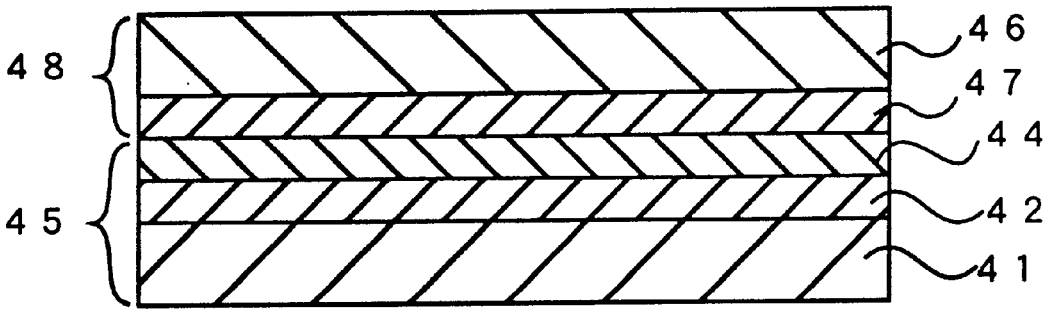
FIG. 4 shows a sectional view of a representative structure of the composite of the invention.

The composite of the invention comprises the image receiving sheet comprising the support sheet and image receiving layer, and the image transfer sheet (Type 1 or 2). The composite is advantageously employed in the following image forming method using a laser light. The structure of the composite having the image transfer sheet (Type 1; fused ink transfer sheet) is shown in FIG. 4.

The light-heat conversion layer 42 is provided on the support sheet 41, and the image formation layer 44 is further provided on the light-heat conversion layer 42, to constitute the image transfer sheet (Type 1) 45. The image transfer sheet 45 is superposed on the image receiving sheet 48 comprising the substrate 46 and the image receiving layer 47, such a manner that the image formation layer 44 is in contact with the image receiving layer 47, to constitute the composite. The image receiving sheet 48 may have the intermediate layer.

Figure 5:
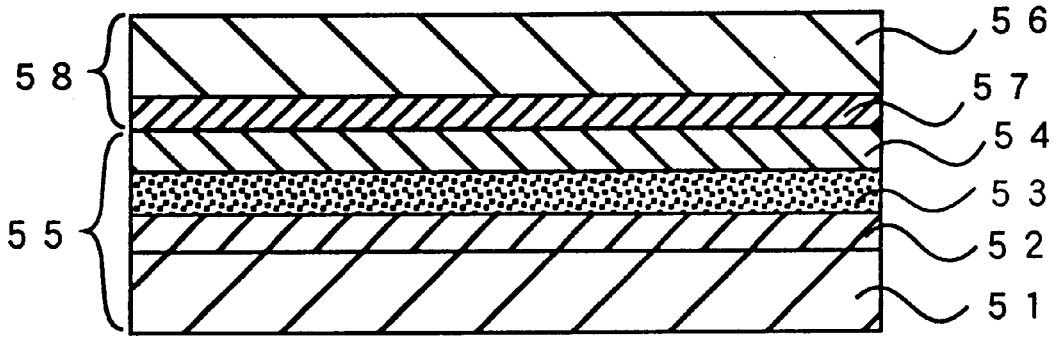
FIG. 5 shows a sectional view of another representative structure of the composite of the invention.

The structure of the composite having the image transfer sheet (Type 2; ablation utilizing transfer sheet) is shown in FIG. 5.

The light-heat conversion layer 52 is provided on the support sheet 51, and the heat-sensitive releasing layer 53 is provided on the light-heat conversion layer 52, and further the image formation layer 54 is provided on the heat-sensitive releasing layer 53, to constitute the image transfer sheet (Type 2) 55. The image transfer sheet 55 is superposed on the image receiving sheet 58 comprising the substrate 56 and the image receiving layer 57, such a manner that the image formation layer 54 is in contact with the image receiving layer 57, to constitute the composite. The image receiving sheet 58 may have the intermediate layer.

Subsequently, the image forming method of the invention is described below.

The image forming method of the invention comprises the steps of: applying a laser light (or laser beam) imagewise and sequentially onto the composite (e.g., one shown in FIG. 5 or 6); and separating the image receiving sheet from other materials of the composite so as to keep on the image receiving sheet an imagewise transferred image formation layer comprising the thermoplastic resin and coloring material. The composite of the image transfer sheet and the image receiving sheet can be formed just before the image forming method is performed.

The procedure for applying the laser light can be done under the condition that the image receiving sheet of the composite is tightly placed on a recording drum (which has a large number of small openings on its surface and is connected to vacuum forming mechanism) by suction, and applying the laser light onto surface of the support of the image transfer sheet. The laser light is scanned onto the surface in the width direction under the condition that the drum rotates at a constant angular velocity.

Examples of the laser lights include gas laser lights such as argon ion laser light, helium-neon laser light and helium-cadmium laser light; solid laser light such as YAG laser light; semiconductor laser light; dye laser light; and excima laser light. The laser light can be modified to reduce its wavelength into a half wavelength by using a secondary high frequency element. In the image forming method of the invention, the laser light emitted from the semiconductor laser is preferred because it gives a laser light of high output power and modulation can be readily done.

In the image forming method of the invention, the laser light is preferably applied onto the image transfer sheet under the condition that the beam diameter formed on the light-heat conversion layer is in the range of 5 to 50 $\mu$m (particularly 6 to 30 $\mu$m). The scanning is preferably done at a velocity of not less than 1 m/sec., specifically not less than 3 m/sec.

The image forming method of the invention is favorably employable for the preparation of black mask or a monocolor image. The image forming method is most favorably employable for the preparation of a multicolor image.

In order to prepare a multicolor image, three or four image transfer sheets having different color material are prepared. Each image transfer sheet is combined with a temporary image receiving sheet and exposed to a laser light which is modulated by a set of digital signals formulated by color separation. The image transfer sheet is peeled off from the image receiving sheet to form an image. Thus processed respective temporary image receiving sheets having images of different colors are finally placed in an appropriate order on a printing paper sheet. In this way, a color proof of multicolor image which has high similarity to the desired printing image can be prepared.

The present invention is further described by the following Examples and Comparison Examples. The term "part (s)" indicated in Example means "weight part(s)".

EXAMPLE 1

(1) Preparation of Image Transfer Sheet

1) Preparation of coating liquid for light-heat conversion layer

The following components were mixed using a stirrer to prepare a coating liquid for light-heat conversion layer:

| | |
|---|---|
| Dye absorbing infrared ray (IR-820B, available from Nippon Kayaku Co., Ltd.) | 5 parts |
| *Varnish of polyamide acid (PAA-A, available from Mitsui Toatsu Chemicals, Inc.) | 40 parts |
| 1-Methoxy-2-propanol | 1000 parts |
| Methyl ethyl ketone | 1000 parts |
| Surface active agent (Megafack F-177, available from Dainippon Ink & Chemicals Inc.) | 1 part |

* The polyamide acid (PAA-A) is prepared by reaction of aromatic tetracarboxylic dianhydride and diamine (25 weight % N,N-dimethylacetoamide solution).

2) Formation of Light-Heat Conversion Layer

The above coating liquid for light-heat conversion layer was coated on a polyethylene terephthalate film (support sheet; thickness: 100 μm) using a whirler, and dried for 2 minutes in an oven of 100° C. to form a light-heat conversion layer (mean thickness: 0.07 μm (measured by observing the section of the light-heat conversion layer using a scanning electron microscope)).

Further, the resultant light-heat conversion layer had the maximum absorption at wavelength of 830 nm within wavelength region of 700 to 1000 nm. The absorbance (optical density) at 830 nm was 0.55.

3) Preparation of Coating Liquid for Image Formation Layer of Black

The following components were mixed using a stirrer to prepare a coating liquid for image formation layer for black image:

Preparation of Mother Liquor

| | |
|---|---|
| Polyvinyl butyral (Denka Butyral #2000-L, 20 weight % n-propyl alcohol solution available from Denki Kagaku Kogyo K.K.) | 12.6 parts |
| Carbon black pigments (MA-100, available from Mitsubishi Chemical Industries, Ltd.) | 24 parts |
| Dispersing agent (Solspers S-20000, available from ICI Japan Co., Ltd.) | 0.8 part |
| n-Propyl alcohol | 110.0 parts |
| Glass beads | 100.0 parts |

The above components were placed in a paint shaker (available from Toyo Seiki Co., Ltd.) and were subjected to dispersing treatment for two hours to prepare the mother liquor.

Preparation of Coating Liquid

| | |
|---|---|
| Mother liquor prepared above | 20 parts |
| n-Propyl alcohol | 60 parts |
| Surface active agent (Megafack F-176PF, available from Dainippon Ink & Chemicals Inc.) | 0.05 part |

The above components were mixed with a stirrer to prepare a coating liquid for forming image formation layer of black mask.

4) Formation of Image Formation Layer of Black Image

The above coating liquid for image formation layer of black image was coated on the light-heat conversion layer using a whirler for one minute, and dried for 2 minutes in an oven of 100° C. to form an image formation layer (mean thickness: 1.1 μm (measured by observing the section of the image formation layer using a scanning electron microscope)).

Further, the resultant image formation layer had the maximum absorption at wavelength of 360 nm within wavelength region of 700 to 1000 nm. The absorbance (optical density) at 360 nm was 3.8.

Thus, an image transfer sheet (black image) composed of a support sheet, a light-heat conversion layer and an image formation layer of black image, was prepared.

EXAMPLE 2

(1) Preparation of Image Transfer Sheet

1) Preparation of coating liquid for light-heat conversion layer

The following components were mixed using a stirrer to prepare a coating liquid for light-heat conversion layer:

| | |
|---|---|
| Dye absorbing infrared ray (IR-820B, available from Nippon Kayaku Co., Ltd.) | 5 parts |
| *Varnish of polyamide acid (PAA-A, available from Mitsui Toatsu Chemicals, Inc.) | 40 parts |
| 1-Methoxy-2-propanol | 600 parts |
| Methyl ethyl ketone | 600 parts |
| Surface active agent (Megafack F-177, available from Dainippon Ink & Chemicals Inc.) | 1 part |

* The polyamide acid (PAA-A) is the same as that in Example 1.

2) Formation of Light-Heat Conversion Layer

The above coating liquid for light-heat conversion layer was coated on a polyethylene terephthalate film (support sheet; thickness: 100 μm) using a whirler, and dried for 2 minutes in an oven of 100° C. to form a light-heat conversion layer (mean thickness: 0.1 μm (measured by observing the section of the light-heat conversion layer using a scanning electron microscope)).

Further, the resultant light-heat conversion layer had the maximum absorption at wavelength of 830 nm within wavelength region of 700 to 1000 nm. The absorbance (optical density) at 830 nm was 1.01.

3) Preparation of Coating Liquid for Heat-Sensitive Releasing Layer

The following components were mixed using a stirrer to prepare a coating liquid for heat-sensitive releasing layer:

| | |
|---|---|
| Nitrocellulose (HIG120, available from Asahi Chemical Co., Ltd.) | 1 part |
| Methyl ethyl ketone | 20 parts |
| Propylene glycol monomethylether acetate | 30 parts |
| Toluene | 70 parts |
| Surface active agent (Megafack F-177PF, available from Dainippon Ink & Chemicals Inc.) | 0.014 part |

4) Formation of Heat-Sensitive Releasing Layer

The above coating liquid for heat-sensitive releasing layer was coated on the light-heat conversion layer using a whirler for one minute, and dried for 2 minutes in an oven of 100° C. to form a heat-sensitive releasing layer (mean thickness: 0.1 μm (measured by observing the section of the layer using a scanning electron microscope)). Further, the resultant heat-sensitive releasing layer had the maximum absorption at wavelength of 830 nm within wavelength region of 700 to 1000 nm. The absorbance (optical density) at 830 nm was 0.96.

5) Preparation of Coating Liquid for Image Formation Layer of Magenta

The following components were mixed using a stirrer to prepare a coating liquid for image formation layer for magenta image:

Preparation of Mother Liquor

| | |
|---|---|
| Polyvinyl butyral (Denka Butyral #2000-L available from Denki Kagaku Kogyo K.K.) | 12.6 parts |
| Magenta pigments (Lionol Red 6B4290G (C.I.Pigment 57:1), available from Toyo Ink Mfg. Co. Ltd.) | 18 parts |
| Dispersing agent (Solspers S-20000, available from ICI Japan Co., Ltd.) | 0.8 part |
| n-Propyl alcohol | 110 parts |
| Glass beads | 110 parts |

The above components were placed in a paint shaker (available from Toyo Seiki Co., Ltd.) and were subjected to dispersing treatment for two hours to prepare the mother liquor.

Preparation of Coating Liquid

| | |
|---|---|
| Mother liquor prepared above | 10 parts |
| n-Propyl alcohol | 60 parts |
| Surface active agent | 0.05 part |

-continued

| | |
|---|---|
| (Megafack F-177PF, available from Dainippon Ink & Chemicals Inc.) | |

The above components were mixed with a stirrer to prepare a coating liquid for forming an image formation layer of magenta.

6) Formation of Image Formation Layer of Magenta

The above coating liquid for image formation layer of magenta image was coated on the heat-sensitive releasing layer using a whirler for one minute, and dried for 2 minutes in an oven of 100° C. to form an image formation layer (mean thickness: 0.3 μm (by observing the section of the layer using a scanning electron microscope)). The obtained ink layer showed optical transmission density of 0.7 (measured by Macbeth densitometer using green filter).

Thus, an image transfer sheet (magenta image) composed of a support, a light-heat conversion layer, a heat-sensitive releasing layer and image formation layer of magenta image, was prepared.

EXAMPLE 3

The procedures of Example 2 were repeated except for employing polyamide acid of the following structure instead of PAA -A for preparing a coating liquid for light-heat conversion layer, to prepare an image transfer sheet and then prepare an image transfer sheet.

Structure of the above polyamide acid

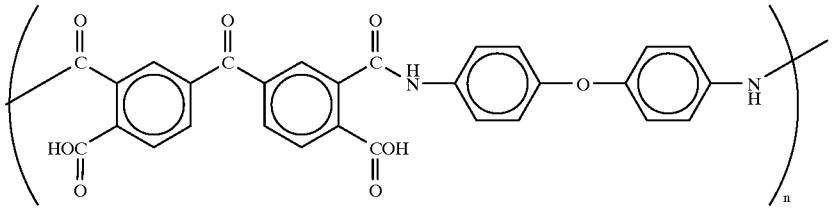

The resultant heat-sensitive peeling layer had mean thickness of 0.1 μm (measured by observing the section of the layer using a scanning electron microscope)). Further, the resultant heat-sensitive releasing layer had the maximum absorption at wavelength of 830 nm within wavelength region of 700 to 1000 nm. The absorbance (optical density) at 830 nm was 1.02.

COMPARISON EXAMPLE 1

The procedures of Example 2 were repeated except for employing the following coating liquid for light-heat conversion layer, to prepare light-heat conversion layer and then prepare an image transfer sheet.

| Coating liquid | |
|---|---|
| Dye absorbing infrared ray (IR-820B, available from Nippon Kayaku Co., Ltd.) | 4 parts |
| Polyvinyl butyral (Denka Butyral #2000-L available from Denki Kagaku Kogyo K.K.) | 40 parts |
| 1-methoxy-2-propanol | 600 parts |
| Methyl ethyl ketone | 600 parts |

-continued

| | |
|---|---|
| Surface active agent (Megafack F-177, available from Dainippon Ink & Chemicals Inc.) | 1 part |

The resultant heat-sensitive peeling layer had mean thickness of 0.1 μm (measured by observing the section of the layer using a scanning electron microscope)). Further, the resultant heat-sensitive releasing layer had the maximum absorption at wavelength of 830 nm within wavelength region of 700 to 1000 nm. The absorbance (optical density) at 830 nm was 1.00.

COMPARISON EXAMPLE 2

The procedures of Example 2 were repeated except for employing the following coating liquid for light-heat conversion layer, to prepare light-heat conversion layer and then prepare an image transfer sheet.

Cyanine dye absorbing infrared rays 4 parts
(FT-5015 available from Nippon Kayaku Co., Ltd,)
of the following structure:

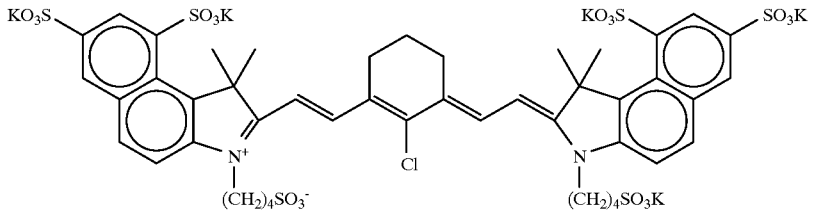

The resultant heat-sensitive peeling layer had mean thickness of 0.1 μm (measured by observing the section of the layer using a scanning electron microscope)). Further, the resultant heat-sensitive releasing layer had the maximum absorption at wavelength of 830 nm within wavelength region of 700 to 1000 nm. The absorbance (optical density) at 830 nm was 1.03.

Evaluation on Image Transfer Sheet

Evaluation in the course of preparation of the image transfer sheet, and that on the resultant image transfer sheet were performed as follows:

(1) Solvent Resistance of Light-Heat Conversion Layer

The process for preparation of image transfer sheet was stopped after a light-heat conversion layer was formed. The resultant support having the light-heat conversion layer was dipped in the solvent contained in the coating liquid for forming heat-sensitive releasing layer or image formation layer. The absorbances (optical density) at 830 nm of the light-heat conversion layer before and after dipping were measured, and solvent resistance was evaluated by difference of the absorbances before and after dipping. A large difference means that the light-heat conversion layer has unsatisfactory solvent resistance.

(2) Durability for Storage

The process for preparation of image transfer sheet was stopped after a light-heat conversion layer was formed. The resultant support having the light-heat conversion layer was allowed to stand for three days under the conditions of 45° C. and 75% RH, and then its absorbance (optical density) at 830 nm was measured to evaluate its durability for storage.

(3) Quality of Transferred Image

By employing the image transfer sheet and the image receiving sheet prepared the following manner, a composite for forming image was prepared. The composite was image-wise exposed to a laser light to form an image and the image was transferred onto the image receiving sheet, and then the transferred image was evaluated by measuring the line width of the image.

The obtained results were set forth in Table 1.

(3)-1 Preparation of Image Receiving Sheet

The following coating liquids for intermediate layer and image receiving layer were prepared:

| | |
|---|---|
| (Coating liquid for intermediate layer) | |
| Vinyl chloride copolymer (Zeon 25, available from Nippon Geon Co., Ltd.) | 9 parts |
| Surface active agent | 0.1 part |

-continued

| | |
|---|---|
| (Megafack F-177P, available from Dainippon Ink & Chemicals Inc.) | |
| Methyl ethyl ketone | 130 parts |
| Toluene | 35 parts |
| Cyclohexanone | 20 parts |
| Dimethylformamide | 20 parts |
| (Coating liquid for image receiving layer) | |
| Methyl methacrylate/ethyl acrylate /metacrylic acid copolymer (Diyanal BR-77, available from Mitsubishi Rayon Co., Ltd.) | 17 parts |
| Alkyl acrylate/alkyl methacrylate, copolymer (Diyanal BR-64, available from Mitsubishi Rayon Co., Ltd.) | 17 parts |
| Pentaerythritol tetraacrylate (A-TMMT, available from Shin Nakamura Kagaku Co., Ltd.) | 22 parts |
| Surface active agent (Megafack F-177P, available from Dainippon Ink & Chemicals Inc.) | 0.4 part |
| Methyl ethyl ketone | 100 parts |
| Hydroquinone monomethyl ether | 0.05 part |
| Photopolymerization initiator (2,2-dimethoxy-2-phenylacetophenone) | 1.5 part |

The above coating liquid for intermediate layer was coated on a polyethylene terephthalate film (thickness: 75 μm) using a whirler, and dried for 2 minutes in an oven of 100° C. to form an intermediate layer (thickness: 1 μm) on the film.

Subsequently, the above coating liquid for image receiving layer was coated on the intermediate layer using a whirler, and dried for 2 minutes in an oven of 100° C. to form an image receiving layer (thickness: 26 μm).

(3)-2 Preparation of Composite for Forming Image

The above image transfer sheet and the above image receiving sheet were allowed to stand at room temperature for one day, and they were placed at room temperature in such a manner that the image formation layer and the image receiving layer came into contact with each other and passed through a couple of heat rollers under conditions of 70° C., 4.5 kg/cm and 200 cm/minute to form a composite. Temperatures of the sheets when passed through the rollers were measured by a thermocouple. The temperatures each were 50° C. The pressure was measured by passing a pressure-sensitive coloring material for measuring pressure (Prescale, available from Fuji Photo Film Co., Ltd.) through the rollers.

(3)-3 Image Recording on Composite

The above composite was cooled at room temperature for 10 minutes. Then, the composite was wound around a rotating drum provided with a number of suction holes in such a manner that the image receiving sheet was in contact with a surface of the rotating drum, and the composite was fixed on the rotating drum by sucking inside of the drum.

The semiconductor laser beam (λ:830 nm, out-put power:110 mW) was focused at a beam diameter of 7 μm on the surface of the light-heat conversion layer of the composite to record a image (line), while, by rotating the drum, the laser beam was moved in the direction (sub-scanning direction) perpendicular to the rotating direction (main-scanning direction).

Main-scanning rate: 10 m/sec.

Sub-scanning pitch (Sub-scanning amount per one rotation): 20 μm (3)-4 Formation and Evaluation of Transferred Image The recorded composite was removed from the drum, and the image transfer sheet was peeled off from the image receiving sheet to obtain the image receiving sheet having the transferred image (lines) of the material of the image formation layer. The transferred image was observed by an optical microscope, and it was confirmed that image comprising lines was recorded only on the exposed area of the image receiving layer. The width of the image line was measured.

The results of these evaluation are set forth in Table 1.

TABLE 1

| | [Light-heat conversion layer] | | | |
|---|---|---|---|---|
| | Solvent resistance | | Durability | [Laser |
| | Absorbance (830 nm) before and after dipping | | 25° C./50%RH Variation of | recording] Line width |
| | Before | After | absorbance | (μm) |
| Example 1 | 0.55 | 0.52 | 0.02 | 5.3 |
| Example 2 | 1.01 | 0.94 | 0.04 | 5.6 |
| Example 3 | 1.02 | 0.95 | 0.02 | 4.8 |
| Co. Ex. 1 | 1.00 | 0.58 | 0.04 | *— |
| Co. Ex. 2 | 1.03 | 1.03 | 0.71 | 5.2 |

Note: * Not transferred

As is apparent from the results of Table 1, the light-heat conversion layer formed of polyamide acid is not damaged by the solvent of the coating liquid of the layer thereon, and therefore IR dye contained in the light-heat conversion layer does not migrate into the upper layer, whereby an transferred image showing no reduction of sensitivity and no occurrence of fog can be obtained (Examples 1–3). In contrast, the light-heat conversion layer formed of polyvinyl butyral is damaged by the solvent of the coating liquid of the layer thereon, and therefore its absorbance is extremely lowered by the solvent. Further, the light-heat conversion layer is fused by heat produced by irradiation of the laser beam to stick onto the heat-sensitive releasing layer and the image formation layer and therefore the formed image cannot be transferred to the image receiving sheet (Comparison Examples 1). Moreover, the light-heat conversion layer formed of polyvinyl alcohol shows poor humidity resistance and therefore the dye in the conversion layer is aggregated after the conversion layer is allowed to stand for a long time under the condition of high temperature and humidity, which results in reduction of its absorbance (Comparison Examples 2).

EXAMPLE 4

(1) Preparation of Sublimation Type Image Transfer Sheet

A light-heat conversion layer was formed on the support in the same manner as in Example 1 except for using a coating liquid for light-heat conversion layer having the following composition, and a coating liquid for image formation layer having the following composition was coated using a wire-bar on the conversion layer to form an image formation layer of the dry coating weight of about 1.5 g/m$^2$.

Thus, an image transfer sheet composed of a support sheet, a light-heat conversion layer and an image formation layer, was prepared.

1) Composition of coating liquid for light-heat conversion layer

| | |
|---|---|
| Dye absorbing infrared ray (IR-820B, available from Nippon Kayaku Co., Ltd.) | 5 parts |
| *Varnish of polyamide acid (PAA-A, available from Mitsui Toatsu Chemicals, Inc.) | 40 parts |
| 1-Methoxy-2-propanol | 600 parts |
| Methyl ethyl ketone | 600 parts |
| Surface active agent (Megafack F-177, available from Dainippon Ink & Chemicals Inc.) | 1 part |

* The polyamide acid (PAA-A) is the same as that in Example 1.

2) Preparation of coating liquid for image formation layer using sublimation dye The following components were mixed using a stirrer to prepare a coating liquid for image formation layer for magenta image:

| | |
|---|---|
| Sublimation dye (Kayaset Blue-136, available from Nippon Kayaku Co., Ltd.) | 4 parts |
| Ethyl hydroxyethyl cellulose (available from Hercules Co., Ltd.) | 6 parts |
| Toluene | 40 parts |
| Methyl ethyl ketone | 40 parts |
| Dioxane | 10 parts |

EXAMPLE 5

(1) Preparation of Sublimation Type Image Transfer Sheet

A light-heat conversion layer was formed on the support in the same manner as in Example 4, and a coating liquid for image formation layer having the following composition was coated using a wire-bar on the conversion layer to form an image formation layer of the dry coating weight of about 1.5 g/m$^2$.

Thus, an image transfer sheet composed of a support sheet, a light-heat conversion layer and an image formation layer, was prepared.

1) Preparation of coating liquid for image formation layer using sublimation dye The following components were mixed using a stirrer to prepare a coating liquid for image formation layer for magenta image:

| | |
|---|---|
| Sublimation dye (Kayaset Blue-906, available from Nippon Kayaku Co., Ltd.) | 10 parts |
| Ethyl cellulose | 10 parts |
| Silica (Syloid, available from Fuji Devison Co., Ltd.) | 10 parts |
| Isopropyl alcohol | 30 parts |

Evaluation on sublimation type image transfer sheet

Evaluation was performed in the same manner as that in Examples 1–3 and Comparison Examples 1–2 (i.e., heat transfer type image transfer sheet), as to (1) Solvent resistance, (2) Durability for storage and (3) Quality of transferred image. However, the laser recording was performed by changing the main-scanning rate from 10 m/sec. to 6 m/sec.

The results of these evaluation are set forth in Table 2.

TABLE 2

| | [Light-heat conversion layer] | | | |
|---|---|---|---|---|
| | Solvent resistance | | Durability | [Laser |
| | Absorbance (830 nm) before and after dipping | | 25° C./50%RH Variation of | recording] Line width |
| | Before | After | absorbance | (μm) |
| Example 4 | 1.01 | 0.97 | 0.02 | 4.8 |
| Example 5 | 1.01 | 0.95 | 0.02 | 4.8 |

As is apparent from the results of Table 2, the light-heat conversion layer formed of polyamide acid is not damaged by the solvent of the coating liquid of the layer thereon in a similar manner as above, and therefore an transferred image showing no reduction of sensitivity and no occurrence of fog can be obtained.

What is claimed is:

1. An image transfer sheet in which a support sheet, a light-heat conversion layer and an image formation layer comprising coloring material and thermoplastic resin are superposed in order, wherein the light-heat conversion layer is formed by coating a coating liquid containing a light-heat conversion material and polyamide acid to form a coated layer and drying the coated layer.

2. The image transfer sheet as defined in claim 1, wherein the drying of the coated layer is performed at a temperature of 80 to 300° C.

3. The image transfer sheet as defined in claim 1, wherein the polyamide acid is formed by reaction of aromatic tetracarboxylic dianhydride and diamine.

4. The image transfer sheet as defined in claim 1, wherein a ratio by weight of the light-heat conversion material and the polyamide acid is in the range of 1:20 to 2:1.

5. The image transfer sheet as defined in claim 1, wherein the light-heat conversion layer has the maximum absorbance at a wavelength within 700 to 2,000 nm of 0.1 to 1.8.

6. The image transfer sheet as defined in claim 1, wherein the light-heat conversion layer has a thickness of 0.03 to 0.8 μm.

7. An image transfer sheet of claim 1 wherein the image formation layer has a thickness of 0.2 to 0.15 μm.

8. An image transfer sheet of claim 1 wherein the image formation layer is formed of a heat sensitive ink material comprising 30–70 weight % of colored pigment and 25–65 weight % of amorphous organic polymer having a softening point of 40 to 150° C.

9. The image transfer sheet of claim 1 wherein the support sheet comprises a material selected from the group consisting of polyethylene terephtalate, polyethylene-2, 6-naphthalate, polycarbonate, polyethylene, polyvinyl, chloride, polyvinylidene chloride, polystyrene and styrene/acrylonitrile copolymer.

10. The image transfer sheet of claim 1 further comprising one or two undercoat layers formed on the surface of said support sheet.

11. The image transfer sheet of claim 1 wherein the light-heat conversion material is a coloring material capable of absorbing a laser light.

12. An image transfer sheet of claim 1 wherein the image forming layer further comprises a plasticizer.

13. An image transfer sheet of claim 1 wherein the image forming layer does not exceed 10 μm.

14. An image transfer sheet in which a support sheet, a light-heat conversion layer, a heat-sensitive releasing layer and an image formation layer comprising coloring material and thermoplastic resin are superposed in order, wherein the light-heat conversion layer is formed by coating a coating liquid containing a light-heat conversion material and polyamide acid to form a coated layer and drying the coated layer and wherein said image formation layer is the top layer of the image transfer sheet.

15. The image transfer sheet as defined in claim 14, wherein the heat-sensitive releasing layer contains a compound producing a gas by heating.

16. An image transfer sheet in which a support sheet, a light-heat conversion layer and an image formation layer comprising sublimation dye and thermoplastic resin are superposed in order, wherein the light-heat conversion layer is formed by coating a coating liquid containing a light-heat conversion material and polyamide acid to form a coated layer and drying the coated layer.

17. A composite which comprises the image receiving sheet comprising a substrate and an image receiving layer thereon, and an image transfer sheet comprising a support sheet, a light-heat conversion layer and an image formation layer comprising coloring material and thermoplastic resin superposed in order, which are superposed in such a manner that the image formation layer is in contact with the image receiving layer;

said the light-heat conversion layer being formed by coating a coating liquid containing a light-heat conversion material and polyamide acid to form a coated layer and drying the coated layer.

18. An image forming method which comprises the steps of:

applying a laser light imagewise and sequentially onto the composite of claim 17; and separating the image receiving sheet from other materials of the composite so as to keep on the image receiving sheet an imagewise transferred image formation layer comprising the coloring material and thermoplastic resin.

19. The composite of claim 17, wherein said image receiving layer of said image receiving sheet comprises a thermoplastic polymer binder.

20. The composite of claim 17, wherein said image receiving sheet further comprises an intermediate layer comprising a photocurable material.

21. An image transfer sheet in which a support sheet, a light-heat conversion layer, a heat-sensitive releasing layer and an image formation layer consisting essentially of coloring material and thermoplastic resin are superposed in order, wherein the light-heat conversion layer is formed by coating a coating liquid containing a light-heat conversion material and polyamide acid to form a coated layer and drying the coated layer.

* * * * *